US006033825A

United States Patent [19]

Rüger et al.

[11] Patent Number: 6,033,825

[45] Date of Patent: Mar. 7, 2000

[54] SILVER-HALIDE RECORDING MATERIAL TO PRODUCE NEGATIVES WITH REDUCED FOG AND ULTRAHARDGRADATION

[75] Inventors: Reinhold Rüger, Rödermark; François Varescon, Neu-Isenburg, both of Germany

[73] Assignee: Agfa-Gevaert NV, Mortsel, Belgium

[21] Appl. No.: 09/171,953

[22] PCT Filed: May 7, 1997

[86] PCT No.: PCT/EP97/02334

§ 371 Date: Oct. 29, 1998

§ 102(e) Date: Oct. 29, 1998

[87] PCT Pub. No.: WO97/42545

PCT Pub. Date: Nov. 13, 1997

[30] Foreign Application Priority Data

May 7, 1996 [DE] Germany ..... 196 18 194

[51] Int. Cl.[7] ..... G03C 1/06

[52] U.S. Cl. ..... 430/264

[58] Field of Search ..... 430/264, 531, 430/944

[56] References Cited

U.S. PATENT DOCUMENTS

| | | | |
|---|---|---|---|
| 3,043,697 | 7/1962 | Foregard et al. | 96/109 |
| 4,929,535 | 5/1990 | Takahashi et al. | 430/264 |
| 4,975,354 | 12/1990 | Machonkin et al. | 430/264 |
| 5,420,004 | 5/1995 | Fujita et al. | 430/559 |

FOREIGN PATENT DOCUMENTS

| | | |
|---|---|---|
| 306 246 | 3/1989 | European Pat. Off. . |
| 11 20 272 | 12/1961 | Germany . |

*Primary Examiner*—Thorl Chea

*Attorney, Agent, or Firm*—Connolly Bove Lodge & Hutz LLP

[57] ABSTRACT

Photographic silver-halide materials for producing negative images with ultrahard-gradation contrast, which contain a hydrazine compound and a contrast-boosting amino compound and/or phosphonium compound, demonstrate a marked tendency to form "black fog" which results in inadequate acutance. By adding 200 to 2500 mg per mol of silver of a polyvinyl lactam to the emulsion, the fog is inhibited and acutance is improved without reducing sensitivity. The invention can be used to produce images during reproduction in the pre-printing stage.

14 Claims, No Drawings

SILVER-HALIDE RECORDING MATERIAL TO PRODUCE NEGATIVES WITH REDUCED FOG AND ULTRAHARDGRADATION

The invention relates to a photographic silver halide recording material for producing black and white negatives with ultrahard-gradation contrast which contains a hydrazine compound and a contrast-boosting amino compound.

During photomechanical reproduction, halftone images frequently have to be converted into raster images. This is achieved using silver halide materials which are developed by special processes to ultrahard-gradation contrast, i.e. to a maximum gradation of the characteristic curve higher than 10. Known processes include, for example, the lithographic process employing low-sulphite, formaldehyde-containing hydroquinone developers. Development in the presence of hydrazine compounds has been widely practised in recent times.

With this process, certain amino compounds are frequently used further to boost the contrast. For example, EP-00 32 456-B1 claims a process in which a recording material is processed in the presence of a hydrazine compound with a hydroquinone-3-pyrazolidinone developer containing a contrast-boosting quantity of an amino compound. However, these developers have a number of drawbacks. For some years, therefore, contrast-boosting amino compounds have also been incorporated into the photographic recording material together with hydrazine compounds.

German Offenlegungsschrift DE-A-43 10 327 describes a process for producing negatives with ultrahard-gradation contrast, in which the silver halide recording material is developed in the presence of compounds of which the molecules contain at least one quaternary nitrogen atom and at least one tertiary amine function.

EP-04 73 342-A1 describes a photographic silver halide material which may be developed to ultrahard-gradation contrast in a developer with a pH<11. The light-sensitive coating of this material contains a hydrazine compound having a specific formula as well as an amino or a quaternary onium compound and is adjusted to a pH of at least 5.9.

U.S. Pat. No. 4,975,354 proposes that certain secondary or tertiary amino compounds also containing at least three oxyethylene units in their molecule be incorporated into the silver halide materials as contrast booster in addition to hydrazine compounds.

EP 04 22 677 describes the use of tertiary amino compounds with at least three oxyethylene units in the molecule as development accelerators in developer solutions which also act in the presence of hydrazine compounds.

EP 05 39 998 claims silver halide materials which contain thioether compounds with a tertiary amino group in addition to hydrazine compounds.

Further amino compounds which have a contrast-boosting effect when incorporated with hydrazine compounds are described in EP-A-06 63 611.

Finally, it is also known from U.S. Pat. No. 4,929,535 that certain phosphonium compounds may display a contrast-boosting effect in hydrazine compound-containing silver halide materials.

A drawback frequently observed in known high-contrast recording materials is a pronounced change in the photographic properties during prolonged storage.

The fog increases in particular. The normal precautions against fog, namely the addition of anti-fogging agents to the emulsion and less intensive chemical ripening have resulted in inadequate speed. Furthermore, the normal anti-fogging agents such as benzotriazoles, nitroindazoles and mercaptotetrazoles inhibit infectious development, resulting in unsatisfactory contrast, particularly in the case of high-speed processing which is normal nowadays.

In particular, high-contrast materials for high-speed processing, of which the layers contain only a few gelatins, have a particular type of fog which is described as black or coal dust fog. It differs from the phenomenon known as peppercorn fog in that the blackened regions are smaller and more numerous. On the other hand, these regions are much greater than those which consist only of one respective developed silver halide grain and are characteristic of the known emulsion fog.

A further drawback of these materials is the low acutance of the line and raster images which are produced with them and may sometimes be due to the fogging at the edges and in the spaces between the lines and dots.

Polyvinyl lactams, in particular polyvinyl pyrrolidinones, have been known for a long time as binders for light-sensitive silver halide layers and are mentioned as such, for example, in Research Disclosure 365044, September 1994, Chapter II C, and 308119, December 1989, Chapter IX B. DE-B-11 20 272, for example, mentions 8 to 50% by weight of the dry emulsion, which may contain 30 to 70% by weight of silver halide, as quantities typical for use as binders. This corresponds to 21.5 to 313 g per mole of silver bromide.

Owing to the use of polyvinyl lactams as binders in high-contrast materials which contain hydrazine compounds and contrast-boosting amino or phosphonium compounds, the speed thereof is reduced below the limit of practical usefulness.

The object of the invention is to propose a silver halide recording material which is suitable for producing negatives with ultrahard-gradation contrast and a short processing time, which has high speed with reduced fog, allows the production of images with high contrast and high acutance, and of which the photographic properties do not deteriorate during storage.

These objects are achieved with a silver halide recording material according to the main claim.

It has in fact surprisingly been found that a photographic silver halide material comprising at least one light-sensitive silver halide emulsion layer on a substrate, the silver halide emulsion layer or a layer in a reactive relationship therewith containing a hydrazine compound and a contrast-boosting amino compound and/or phosphonium compound, has excellent fog and speed values with exceptional acutance and good stability in storage if the silver halide emulsion layer or a layer in a reactive relationship therewith contains a polyvinyl lactam in a quantity of 250 to 2500 mg per mole of silver halide. The term polyvinyl lactam in this case denotes a vinyl polymer of which at least 80% by weight consists of N-vinyl lactam groups.

A person skilled in the art did not expect this effect. In fact, the above-mentioned DE-B-11 20 272 describes how increased fog which has to be reduced by further additives occurs when polyvinyl lactams are used as binders in negative emulsions to increase the coverage.

The polyvinyl lactam to be used according to the invention is preferably a poly-N-vinyl pyrrolidinone.

The average molar mass of the polyvinyl lactam is preferably between 6000 and 100000; the range between 15000 and 50000 is particularly preferred.

In a further preferred embodiment, the quantity of polyvinyl lactam used is between 250 and 1000 mg per mole of silver halide; the range from 400 to 1000 mg is particularly preferred.

The hydrazine compound contained in the recording material according to the invention may be incorporated into either one or several layers of the recording material in a known manner. These may be layers which contain the light-sensitive silver halide as well as layers which are in a reactive relationship with the aforementioned layers, i.e. are so arranged that substances are able to diffuse from one layer to the other if a concentration gradient is maintained by reactions. Solutions as well as dispersions of the hydrazine compound may be added to the coating solutions to assist incorporation.

Suitable hydrazine compounds are described, for example, in Research Disclosure 235 010 (November 1983),

| | | |
|---|---|---|
| DE-27 25 743-A1, | EP-00 32 456-B1, | EP-01 26 000-A2, |
| EP-01 38 200-A2, | EP-02 03 521-A2, | EP-02 17 310-A2, |
| EP-02 53 665-A2, | EP-03 24 391-A2, | EP-03 24 426-A2, |
| EP-03 26 443-A2, | EP-03 56 898-A2, | EP-04 73 342-A1, |
| EP-05 01 546-A1, | EP-04 81 565-A, | EP-05 98 315-A1, |
| EP-04 44 506-A. | | |

Preferred hydrazine compounds are described by the general formula (H)

B-phenyl-NHNH-L-G (H)

B represents a ballast group, G an activating group and L one of the groups —CO— and —C—CO—. "Phenyl" represents a phenylene ring to which B and the hydrazine group are bound, preferably in the para-position, and which may be further substituted.

Preferred ballast groups include those which do not attract electrons, for example straight or branched alkyl groups, (for example methyl, ethyl, n-propyl, isopropyl, n-butyl, isobutyl, n-hexyl, n-octyl, t-octyl, n-decyl, n-dodecyl and similar groups), also alkoxy groups which contain one of the aforementioned alkyl groups as alkyl, as well as acylamino groups such as acetylamino, propanoylamino, butanoylamino, octanoylamino, benzoylamino, alkyl and arylsulphonamido and similar groups.

The above-mentioned groups may in turn be substituted with conventional photographic ballast groups as known from incorporated diffusion-resistant couplers and other immobilised photographic additives. These ballast groups typically contain at least 8 carbon atoms and may be selected from relatively inert aliphatic or aromatic groups, for example alkyl, alkoxy, phenyl, alkylphenyl, phenoxy, alkylphenoxy, arylacyl, arylamindo, alkylpyridinium-1-ylamido and similar groups.

The alkyl and alkoxy groups, including any ballast groups, preferably contain 1 to 20 carbon atoms and the acyl amino groups preferably 2 to 21 carbon atoms. However, these groups may contain up to 30 or more carbon atoms. Methoxyphenyl, tolyl, ballasted butyramidophenyl, butylsulphonamido and toluylsulphonamido are particularly preferred.

The preferred hydrazine compounds include those whose ballast group additionally contains an adsorption-promoting group. These groups promote the adsorption of the molecule on the surface of the silver halide crystals and are known per se. They typically contain at least one sulphur or nitrogen atom which is capable of forming a silver complex or otherwise has affinity for the silver halide surface. Preferred examples include thiourea, thiuronium, heterocyclic thioamide and triazole groups.

G is preferably hydrogen, optionally substituted alkyl (for example methyl, hydroxymethyl, monofluoromethyl, pyridinomethyl, phenoxymethyl, alkoxymethyl such as methoxymethyl), optionally substituted aralkyl (for example benzyl, o-hydroxybenzyl) and optionally substituted aryl (for example phenyl, 3,5-dichlorophenyl, o-methanesulphonamidophenyl, 4-methanesulphonylmethyl, 2-hydroxymethylphenyl), alkyl groups containing electron-attracting substituents, for example cationic groups with a quaternary nitrogen atom such as pyridinium and imidazolium, being particularly preferred.

G may also be further substituted, for example by alkyl, aralkyl, alkenyl, alkinyl, alkoxy, aryl, substituted amino, ureido, urethane, aryloxy, sulphamoyl, carbamoyl, alkyl or arylthio, alkyl or arylsulphonyl, alkyl or arylsulphinyl, hydroxy, halogen, cyan, sulpho, aryloxycarbonyl, acyl, alkoxycarbonyl, acyloxy, carbamide, sulphonamide, carboxyl, phosphamide, diacylamino, imide.

G may also be selected such that the L-G part of the molecule is separated with ring formation, as described, for example, in EP-B-02 53 665.

Examples of suitable hydrazine compounds include:

H-1

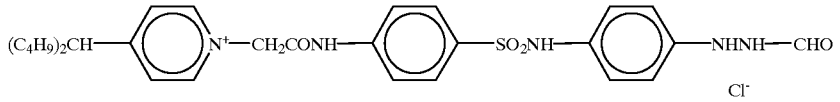

H-2

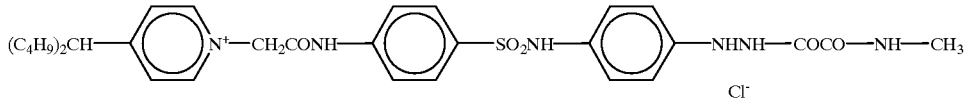

-continued
H-3
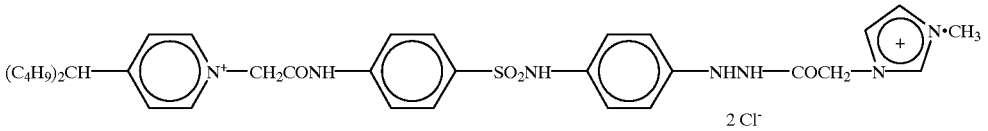
H-4
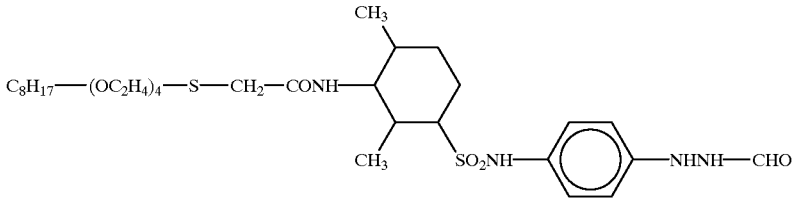
H-5
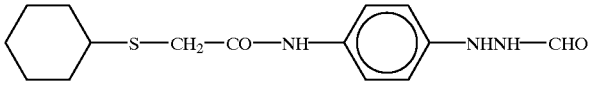
H-6
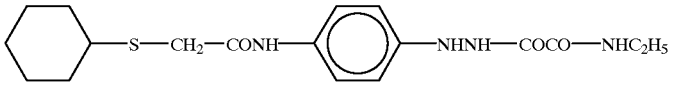
H-7
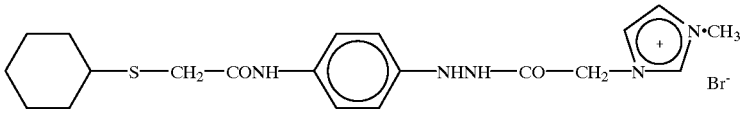
H-8
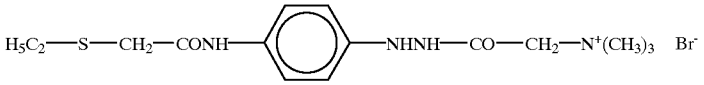
H-9
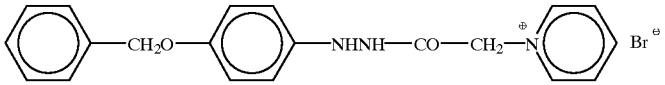
H-10
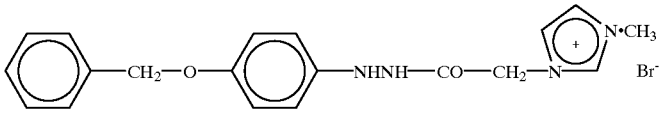
H-11
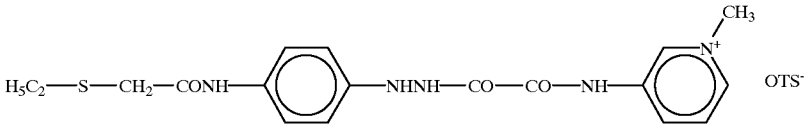
H-12
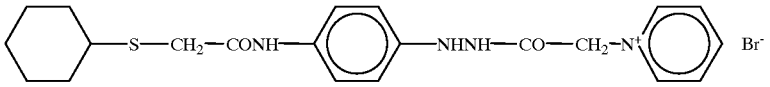
H-13
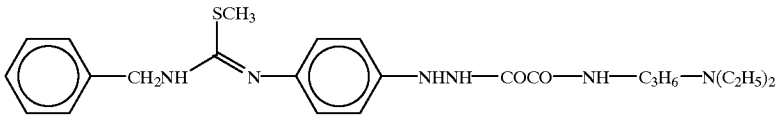

-continued
H-14
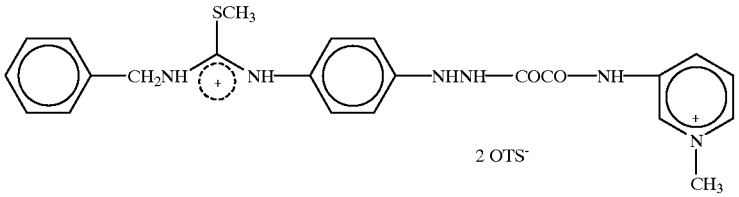
H-15
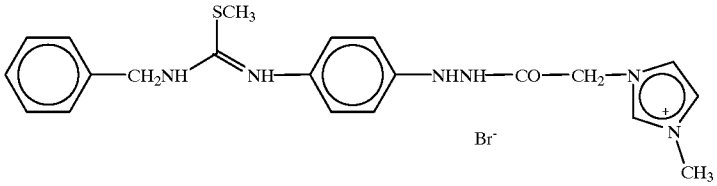
H-16
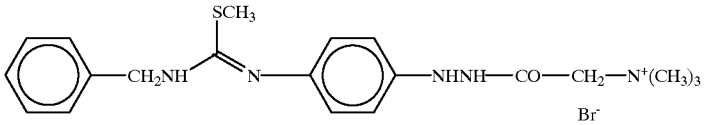
H-17
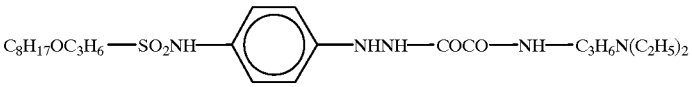
H-18
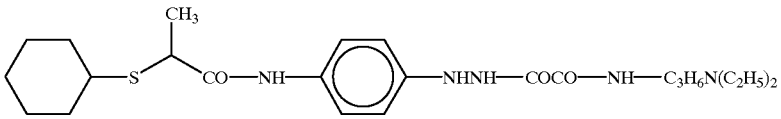
H-19
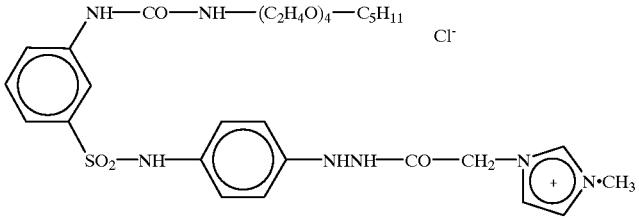
H-20
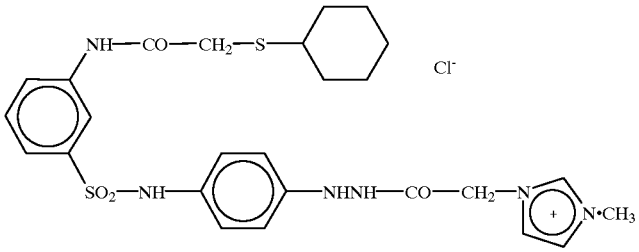
H-21
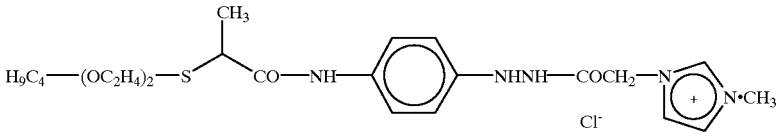

The quantity of hydrazine compound is preferably between $10^{-6}$ and $10^{-2}$ mol per mole of silver halide.

Suitable contrast-boosting amino compounds are known, for example, from U.S. Pat. No. 4,914,003, EP-A-06 18 491 and EP-A-06 63 611 and from German patent application 19515619.6.

Amino compounds corresponding to general formula (A) are particularly preferred.

(A)

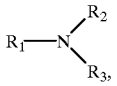

wherein each of the substituents $R_1$, $R_2$ and $R_3$ may be a hydrogen atom, an alkyl group, a substituted alkyl group, an alkenyl group, a substituted alkenyl group, an alkinyl group, an aryl group or a substituted aryl group, but the three are not all simultaneously hydrogen. The substituents may also be linked to one another to form one or two rings and may in turn be substituted by diffusion-inhibiting (ballast) groups and/or groups which promote adsorption with respect to silver halide surfaces.

Preferred amino compounds contain, in their molecule, at least one secondary or tertiary amino group and additionally a group with a quaternary nitrogen atom, a polyoxyalkylene chain, a thioether or thioketone group, a nitrile group, a sulphonyl urea or urethane group or a guanidine group.

In a particularly preferred embodiment of the invention, the contrast-boosting amino compound falls under one of general formulae (B), (C) or (D):

$$RR^1N—X—(CN)_n \quad (B)$$

$$NC—X—NR^2—B—NR^2—X—CN \quad (C)$$

$$RR^1N—X—N(CH_2CN)_2 \quad (D)$$

The radicals R and $R^1$, which may be the same or different, each represent a straight-chained or branched alkyl group containing 1 to 6 carbon atoms, for example methyl, ethyl, n-propyl, isopropyl, n-butyl, isobutyl, n-hexyl. While including the nitrogen atom and optionally a further nitrogen atom, an oxygen atom or a carbonyl group, they may also form a heterocyclic ring with 5 to 12 members, for example a piperidine, pyrrolidine, pyrroline, oxazolidine, imidazoline, morpholine, pyrazane, azepine, oxazepine or azacyclodecane ring. Each of the groups R and $R^1$ may also be a benzyl group. The groups R and $R^1$ and also the heterocyclic rings corresponding to these groups may be further substituted, preferably with hydroxyl, alkoxy, alkylthio or alkylamino groups, wherein the alkyl may contain 1 to 6 carbon atoms. Examples of these substituents include methoxy, ethoxy, propoxy, butoxy, ethylamino, dimethylamino, butylthio.

R or $R^1$ with their free end may also link with the combining group X to form a ring which includes the nitrogen atom of the tertiary amino group. A ring of this type may be, for example, a piperidine ring or a morpholine ring.

The divalent groups X and B to be combined are preferably straight-chained, branched or cyclic alkylene groups containing 1 to 20 carbon atoms, phenylene or aralkylene groups containing 7 to 20 carbons atoms or divalent chains consisting of 1 to 20 methylene groups in which oxygen, sulphur, amino groups, alkene or alkine groups or also polyoxyalkylene groups, in particular polyoxyethylene or polyoxypropylene groups containing 1 to 50 oxyalkyl units may additionally be incorporated. An ethylene or propylene group is particularly preferred. The above-mentioned groups may also be further substituted, for example with alkyl, hydroxyl and further tertiary amino groups.

The combining group X may also be trivalent and thus combine the tertiary amino group with two nitrilo groups. The groups mentioned in the foregoing paragraph are suitable if they comprise a further free valency instead of a hydrogen atom. Examples include:

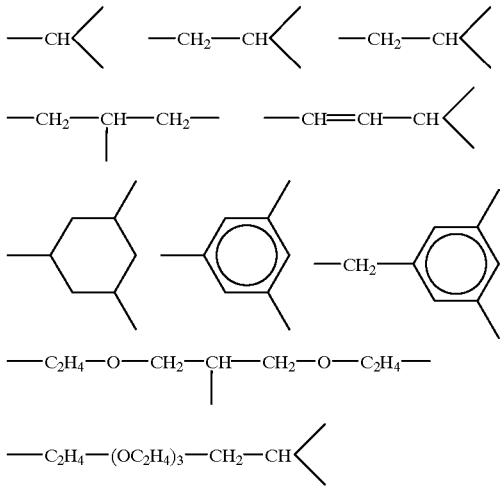

The radical $R^2$ in general formula (C) represents a saturated or unsaturated alkyl group, preferably containing 1 to 12 carbon atoms, an aryl group, preferably containing 6 to 14 carbon atoms or an aralkyl group, preferably containing 7 to 15 carbon atoms. These groups may in turn be substituted, for example with hydroxyl, amino, alkylamino and alkoxy groups, the alkyl preferably containing 1 to 6 carbon atoms. If an alkyl group is involved, it may also be bound by its end remote from the nitrogen to a carbon atom from group B to form a ring. A ring of this type may be, for example, a piperidine, pyrrolidine or hexahydroazepine ring. The two radicals $R^2$ may also form, together with B or with parts of B and with the two nitrogen atoms, one or two saturated rings, preferably with 5 or 6 members, for example pyrrolidine or piperidine rings.

Examples of suitable amino compounds include:

A-1

$$(C_2H_5)_2N—C_3H_6—CN \quad HCl$$

A-2

$$(i\text{-}C_3H_7)_2N—C_2H_4—CN \quad HCl$$

A-3

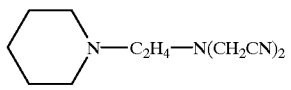

A-4

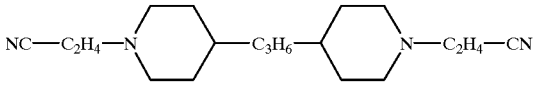

-continued

A-5

$(C_2H_5)_2N—C_2H_4—O—C_2H_4—CN$

A-6

$(C_2H_5)_2N—C_2H_4—S—C_2H_4—CN$

A-7

$(C_2H_5)_2N—CH_2—CHOH—CH_2OH$

A-8

$(C_4H_9)_2N—C_3H_6—CO—NH—$

A-9

$(C_2H_5)_2N—C_3H_6—NH—CO—$ $—O—C_2H_5$ HCl

A-10

$(C_3H_7)_2N—C_2H_4—(OC_2H_4)_{14}—N(C_3H_7)_2$

A-11

$(CH_3)_2N—C(=N—C_2H_4—N(CH(CH_3)_2)_2)—(CH_3)_2N$ HCl

A-12

$(CH_3)_2N—C(=N—C_2H_4—N)—(CH_3)_2N$ HCl

A-13

$(CH_3)_2N—C(=N—C_2H_4—N)—(CH_3)_2N$ HCl

A-14

$[(C_2H_5)_2N—C_2H_4—NH—COCO—NH—(C_2H_4O)_2—CH_2]_2$ 2 HCl

A-15

$N—(CH_2)_4COO—$ $—OC_4H_9$

A-16

$N—(CH_2)_3NHCONH(CH_2)_3OC_{16}H_{33}$

A-17

$C_{12}H_{25}N(CH_2CH_2O)_mH(CH_2CH_2O)_nH$ $m,n = 0 \ldots 20$

A-18

$N—(CH_2CH_2O)_2—CH_2CH_2S—(CH_2CH_2O)_2—CH_2CH_2—N$

A-19

$(C_2H_5)_2N—CH_2CH_2—CON^-—N^+$

A-20

$(C_2H_5)_2N—(CH_2)_3—NHCO—CH_2—N^+$ $—CH(C_2H_5)_2$ $Cl^-$

A-21

$N—CH_2CH_2NH—C(=S)—NHCH_2CH_2—N$

-continued

A-22

$NH—N=N—C(=O)—NHCH_2CH_2—N$

A-23

$NH—N=N—C(=O)—NHCH_2CH_2—N$

A-24

$N—C_2H_4—CN$ HCl

A-25

$N—C_3H_6—CN$

A-26

$(C_4H_9)_2N—C_2H_4—CN$ HCl

A-27

$(C_4H_9)_2N—C_3H_6—N(CH_2CN)_2$

A-28

$N—C_2H_4—CH(CN)_2$

A-29

$—CH_2—N—CH_2—CN$

A-30

$(C_2H_5)_2N—C_3H_6—C(OH)(CH_3)—CN$

A-31

$(H_9C_4)_2N—(CH_2CH_2O)_{\sim 14}—CH_2CH_2—N(C_4H_9)_2$

A-32

$[(C_2H_5)_2N—(C_2H_4O)_2—CH_2CHOHCH_2—OCH_2—]_2$

A-33

$(C_2H_5)_2N—CH_2CHOHCH_2—O—CH_2CH_2—CH_2CHOHCH_2—N(C_2H_5)_2$

A-34

$[(C_2H_5)_2N—(CH_2CH_2O)_2—CH_2CHOHCH_2—OCH_2CH_2—]_2$

A-35

$(C_2H_5)_2N—CH_2CH_2—N—(+)—N—CH_2CH_2—N(C_2H_5)_2$ $Cl^-$

A-36

$N—CH_2CH_2—N^-$ $—N$ $Cl^-$

A-37

$(C_4H_9)_2N—CH_2CH_2CH_2—NH—SO_2—$ HCl

A-38

$(C_4H_9)_2N—CH_2CH_2CH_2—NH—SO_2—N$ $O$

-continued

A-39

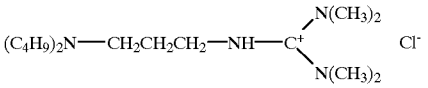

A-40

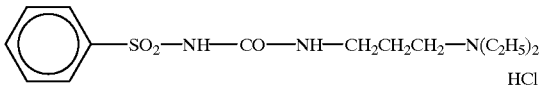

A-41

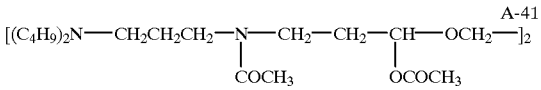

A-42

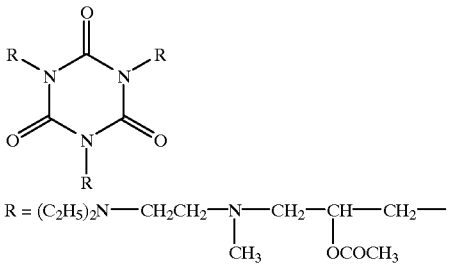

Suitable contrast-boosting phosphonium compounds are described, for example, by general formula (P)

(P)

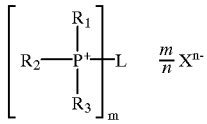

wherein $R^1$, $R_2$ and $R_3$ each represent an alkyl, cycloalkyl, aryl, alkenyl or cycloalkenyl group or a heterocyclic group, wherein these groups may each also have substituents, L represents an m-valent organic group bound to the phosphorus atom via a carbon atom, n represents 1, 2 or 3, X represents an n-valent anion which may also be bound to L.

Examples of suitable phosphonium compounds include

P-1

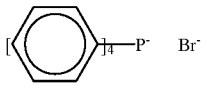

P-2

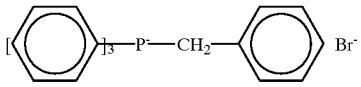

P-3

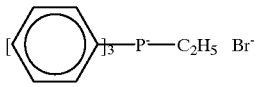

P-4

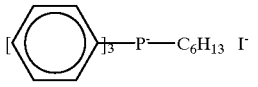

-continued

P-5

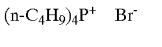

P-6

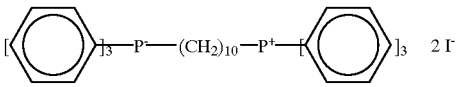

P-7

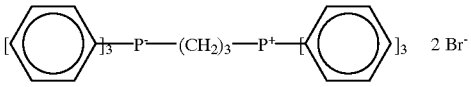

P-8

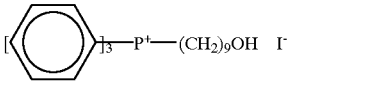

P-9

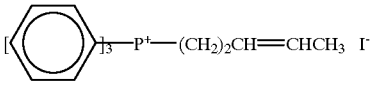

P-9

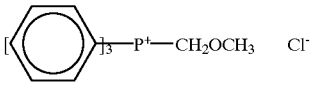

P-10

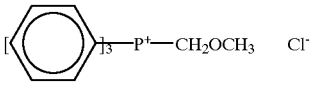

P-11

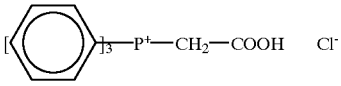

P-12

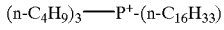

P-13

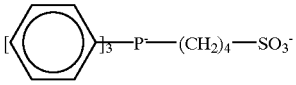

P-14

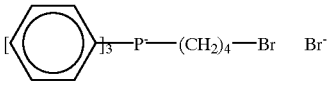

P-15

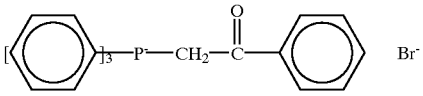

The light-sensitive silver halides in the recording materials used according to the invention consist of silver chloride, silver bromide, silver chlorobromide, silver bromoiodide or silver chlorobromoiodide, silver bromide and silver bromoiodide being preferred. They may be monodisperse or polydisperse, have a uniform composition or also contain grains with a core and shell structure, as well as mixtures of grains having different compositions and grain size distributions. They are produced using a hydrophilic colloidal binder, preferably gelatin. The silver. halide grains may have a spherical, polyhedric or platy configuration. A person skilled in the art is familiar with methods of producing suitable light-sensitive silver halide emulsions which are summarised, for example, in Research Disclosure 365 044, Chapters I to IV (September 1994).

Silver halide emulsions which are produced by controlled double-beam influx and have a cubic grain shape are preferred for the recording materials used according to the invention. Emulsions in which at least 80% by weight of the silver halide is in cubic form are advantageous. Monodisperse emulsions, i.e. those in which the variation coefficient (quotient of standard deviation and mean value) of the grain size is smaller than 0.30 are particularly preferred. The term grain size denotes the edge length of a cube having the same volume as the actual grain.

The grain volume of the silver halide grains in the emulsions is based on the required speed and may correspond, for example, to a cubic grain having an edge length of 0.1 to 0.7 $\mu$m. A preferred range lies between 0.15 and 0.30 $\mu$m. Salts of precious metals, in particular salts of rhodium or iridium, may be present in the normal quantities to control the photographic properties during production of the emulsions.

The emulsions are preferably chemically sensitised. Suitable processes include sulphur, reduction and precious metal sensitisation, which may also be combined. Gold or iridium compounds, for example, may be used for precious metal sensitisation. Sensitisation is preferably carried out in the presence of salts of organic thiosulphonic acids such as p-toluene thiosulphonic acid.

The emulsions may be spectrally sensitised with conventional sensitisation dyes, as described, for example, in Research Disclosure 365 044, Chapter V (September 1994). Sensitisers for red (wavelength 600 . . . 690 nm) and infrared (>690 nm) light are preferred.

The emulsions may also contain conventional anti-fogging agents. Optionally substituted benzotriazole, 5-nitroindazole and 1-phenyl-5-mecaptotetrazole are preferred. These agents may be added at any time during production of the emulsions or may be contained in an auxiliary layer of the photographic material. An iodide, preferably an alkali iodide, may be added to the emulsion before or after chemical ripening, in a quantity of about 0.5 to 5 millimoles per mole of silver to improve the photographic properties.

The emulsions may also contain known polymer dispersions by means of which, for example, the dimensional stability of the photographic material is improved. These are generally latices of hydrophobic polymers in an aqueous matrix. Examples of suitable polymer dispersions are mentioned in Research Disclosure 176 043, Chapter IX B (December 1978). Polymers of acrylic and methacrylic acid esters are preferred, $C_1$ to $C_6$-esters being particularly preferred. The particle size of these polymer latices is preferably between 20 and 100 nm.

The layers of the photographic materials may be cured by addition of a curing agent. Curing agents are mentioned, for example, in Research Disclosure 365 044, Chapter II B (September 1994). This curing agent may be added to the emulsion or introduced via an auxiliary layer, for example a protective outer layer. Suitable curing agents include, for example, aldehydes such as formaldehyde or glutaraldehyde, vinyl sulphones, s-triazines, aziridines, carbodiimides, carbamoylpyridinium compounds, mono- and difunctional carbamoylimidazolium compounds. Hydroxydichlorotriazine is a preferred curing agent.

The photographic material may contain further additives which are known and conventional for producing specific properties. These agents are mentioned in the Research Disclosure 365 044 (September 1994) in Chapers VI (brighteners), IX A (coating auxiliaries), IX B (plasticisers and lubricants) and IX D (delustring agents).

The gelatin content of the emulsions is generally between 30 and 150 g per mole of silver. The range is preferably between 40 and 100 g per mole of silver.

The silver halide materials according to the invention may be used for producing black and white negatives with ultrahard-gradation contrast. They may be exposed image-wise with a suitable light source for this purpose. This may be effected all over using a master, for example with an incandescent lamp or a discharge lamp, optionally by means of a colour filter, or alternatively by scanning with an intensity-modulated light beam, for example from a gas, solid or semiconductor laser. A preferred process employs a HeNe laser or a semiconductor laser with emission in the red range of the spectrum.

Processing of the exposed material to produce the image preferably involves treatment with an aqueous development bath, with an aqueous fixing bath, washing and drying.

Processing is preferably carried out as a high speed process with a development time of at most 30 s and appropriately adapted developer temperature, for example 32° C. and higher. To attain a high speed of development and to minimize the quantity of waste solution by a low regeneration rate, it is preferable to use developer solutions with a high content of developer substance, for example more than 25 g per liter.

The developer solutions preferably contain a dihydroxybenzene developer substance, for example hydroquinone, catechol, methyl hydroquinone or chlorohydroquinone, and an antioxidant, preferably an alkali sulphite in a concentration higher than 0.3 moles per liter. Solutions with pH values of 9 to at most 11 are preferably used, and those with pH values of 10 to 10.5 particularly preferably used. These developer solutions are also stable in use. Developer solutions with a developer substance of the ascorbic acid type, for example L-ascorbic acid, D-ascorbic acid, L-erythroascorbic acid, 6-desoxy-L-ascorbic acid, imino-L-erythroascorbic acid or sugar derivatives of these acids may also be used. Developer solutions which contain developer substances of the dihydroxybenzene type as well as those of the ascorbic acid type are also suitable.

The developer solutions preferably contain known auxiliary developer substances which have a superadditive effect, for example N-methyl-p-aminophenol or 1-phenylpyrazolidinone-3 or derivatives of these compounds.

Developers containing anti-fogging agents from the benzotriazole group are also preferred. These anti-fogging agents include, for example, benzotriazole, 5-chlorobenzotriazole, 5-bromobenzotriazole, 5-methylbenzotriazole, 5-nitrobenzotriazole, 5-benzoylaminobenzotriazole, 1-hydroxymethylbenzotriazole, 6-cyanobenzotriazole.

The recording materials according to the invention are distinguished by low fog values and excellent stability in storage. This applies, in particular, to low black fog. On the other hand, the materials according to the invention also have high gradation in the foot and central region. Owing to the low fog and the high foot gradation, the exposure tolerance may be fully ultilised and an optimum raster range achieved as the sensitivity to scattered light is reduced.

The invention may be used for producing black and white negatives with ultrahard-gradation contrast, in particular during reproduction in the pre-printing stage for black and white and multi-coloured printing.

The quantities of emulsion additives in the following embodiment relate to one mole of silver halide, unless otherwise stated.

A cubic silver bromoiodide emulsion having grains with an edge length of 0.18 $\mu$m is produced by pAg controlled double beam precipitation. The iodide content is 2 mole % based on silver. This emulsion is flocculated, washed and chemically ripened with $10^{-5}$ moles of hexachloroplatinic acid, 8 mg of potassium thiotosylate, 6 mg of benzene sulphinic acid, 0.4 millimoles of thiosulphate and 0.1 millimoles of tetrachloroauric acid. At the end of chemical ripening, a further 400 mg of sodium sulphate and 5 millimoles of potassium iodide, 300 mg of 7-hydroxy-1-methyltriazaindoline, 200 mg of 5-nitroindazole, 0.15 millimoles of 1-pyridiniumacetyl-2-(4-benzyloxyphenyl)-hydrazinebromide (compound H-9) and 600 mg of 4,4'-trimethylene-bis-piperidinopropionitrile (compound A-4), a red sensitiser (KF 641, manufactured by Riedel-de Haën), sodium tetradecylsulphonate as coating auxiliary and respective parts of the emulsion thus obtained, polyvinylpyrrolidinone MW 30 000 (PVP) are added in various quantities according to Table 1. Red-sensitive scanner films were produced by application of the emulsions together with two protective gelatin layers (0.9 g of gelatin per $m^2$ in total) to a polyethylene terephthalate substrate provided with an antistatic and anticurl layer on the back. 3.5 g per $m^2$ of silver were applied. The protective layers also contained hydroquinone, polyethylene oxide 20000, 500 mg/$m^2$ of colloidal silica and a polyolefin oxidate according to DE 43 11 888. The layers were cured with 1 millimole of hydroxydichlorotriazine, sodium salt and 0.1 millimole of bis-dimethylcarbamoylimidazolium chloride, per gram of gelatin in each case.

Samples of the films were then exposed with a flashlight ($10^{-3}$ s) through a red filter and a density gradient profile and were processed in a developer having the composition specified hereinafter in an automatic development machine (DuPont ECP 55) with a development time of 30 s at 35° C. A conventional commercial fixing bath was used. Foot gradation GI between the density values 0.1 and 0.4, gradation G2 between the densities 0.4 and 3.5, fog Dmin, maximum density Dmax and speed S were determined on the processed samples in relative arithmetic units, 3 days and 3 months after production. The samples were stored at 22° C. and 55% relative humidity.

Raster elements were produced by exposure of raster dots with a conventional commercial scanning exposure device (Linotronic 300 manufactured by Hell) and development as above, for assessing the acutance of the image dots. They were assessed visually using an 80-fold magnifying glass. Table 1 shows the results. The test results after 3 months' storage of the material are shown in brackets.

| Developer composition: | |
|---|---|
| Water | 500 g |
| Sodium bisulphite | 50 g |
| KOH | 27 g |
| EDTA trisodium salt | 3.7 g |
| Hydroquinone | 25 g |
| Potassium bromide | 4 g |
| Benzotriazole | 0.3 g |
| Phenylmercaptotetrazole | 0.05 g |
| 4-hydroxymethyl-4-methyyl-1-phenylpyrazolidinone | 1 g |
| Boric acid | 3 g |
| Sodium hydroxide | 24 g |
| Diethylene glycol | 40 g |
| Adjust to 1 litre with water, pH to 10.5 at 22° C. | |

TABLE 1

| Sample | PVP (mg) | Dmin | Dmax | S | G1 | G2 | Acutance | E/V |
|---|---|---|---|---|---|---|---|---|
| 1 | 0 | 0.12 | 5.8 | 140% | 1.8 | 10.2 | −− | V |
| | | (1.95) | (n.a.) | (n.a.) | (n.a.) | (n.a.) | (n.a) | |
| 2 | 150 | 0.07 | 5.8 | 125% | 3.0 | 11.1 | − | V |
| | | (0.19) | (5.8) | (134%) | (1.6) | (9.0) | (−−) | |
| 3 | 250 | 0.05 | 5.8 | 100% | 5.6 | 13.5 | ++ | E |
| | | (0.05) | (5.8) | (96%) | (5.0) | (13.0) | (++) | |
| 4 | 400 | 0.05 | 5.8 | 94% | 6.3 | 13.1 | ++ | E |
| | | (0.05) | (5.8) | (90%) | (6.0) | (13.0) | (++) | |
| 5 | 900 | 0.05 | 5.8 | 82% | 5.9 | 13.0 | ++ | E |
| | | (0.05) | (5.8) | (77%) | (5.0) | (12.0) | (++) | |
| 6 | 1500 | 0.05 | 5.8 | 60% | 4.5 | 12.0 | ++ | E |
| | | (0.05) | (5.8) | (58%) | (4.2) | (11.0) | (++) | |
| 7 | 2500 | 0.05 | 5.5 | 46% | 3.5 | 11.0 | + | E |
| | | (0.05) | (5.5) | (46%) | (3.0) | (11.0) | (+) | |
| 8 | 3500 | 0.05 | 5.0 | 35% | 2.2 | 9.0 | − | V |
| | | (0.05) | (4.7) | (33%) | (1.9) | (8.0) | (−) | |

In Table 1,
E denotes material according to the invention,
V denotes comparison material,
n.a. denotes not evaluated owing to high fog,
−− or − unservicable, i.e. very poor or poor acutance
++ or + servicable, i.e., very good or good acutance.

We claim:

1. Photographic silver halide material comprising at least one light-sensitive silver halide emulsion layer on a substrate, the silver halide emulsion layer or a layer in a reactive relationship therewith containing a hydrazine compound and a contrast-boosting amino compound and/or phosphonium compound, and the silver halide emulsion layer or in a layer in a reactive relationship therewith, contains a vinyl polymer of which at least 80% by weight consists essentially of N-vinyl lactam groups, in a quantity of 250 to 2500 mg per mole of silver halide.

2. Material according to claim 1, wherein the polyvinyl lactam is present in the silver halide material in a quantity of 250 to 1000 mg per mole of silver halide.

3. The material according to claim 2, wherein the polyvinyl lactam is present in the silver halide material in a quantity of 400 to 1000 mg per mole of silver halide.

4. Material according to claim 1, wherein the polyvinyl lactam is a polyvinyl pyrrolidinone.

5. The material according to claim 4, wherein said polyvinyl pyrrolidinone has a molar mass of 6,000 to 100,000.

6. The material according to claim 4, wherein the average molar mass is in the range between 15,000 and 50,000.

7. Material according to claim 1, wherein the hydrazine compound has the formula B-phenyl-NHNH-L-G wherein B is a ballest group, G an activating group, and -phenyl- an optionally substituted phenylene radical and L is CO or CO—CO.

8. Material according to claim 1, wherein the contrast-boosting amino compound is of the formula (A)

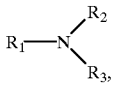

(A)

wherein each of the substituents $R_1$, $R_2$ and $R_3$ are identical and different and are a hydrogen atom, an alkyl group, a substituted alkyl group, an alkenyl group, a substituted alkenyl group, an alkinyl group, an aryl group or a substituted aryl group, the substituents may be linked to form one or two rings, but $R_1$, $R_2$ and $R_3$ are not all simultaneously hydrogen.

9. Material according to claim 1 wherein the contrast-boosting amino compound is of the formulae $$RR^1N—X—(CN)_n \quad (B)$$

$$NC—X—NR^2—B—NR^2—X—CN \quad (C)$$

$$RR^1N—X—N(CH_2CN)_2 \quad (D)$$

wherein

R and $R^1$, which may be the same or different, each represent an optionally substituted alkyl group containing 1 to 6 carbon atoms or an optionally substituted benzyl group; wherein the substituents are hydroxyl, alkoxy, alkylthio or alkylamino groups, or R and $R^1$ together with the nitrogen atom and optionally a further oxygen or nitrogen atom, form a 5- to 12 membered heterocyclic ring, $R^2$ represents a saturated or unsaturated alkyl group or an aryl group, wherein said alkyl or aryl group may be further substituted with a hydroxyl, amino, alkylamino and alkoxy groups, or said alkyl group having its free end which may form with B a piperidine, pyrrolidine and hexahydroazepine ring these groups may be further substituted, X represents a divalent or trivalent combining group, B represents a divalent combining group, n is 1 or 2.

10. The material according to claim 9, wherein $R^2$ is a saturated or unsaturated alkyl group containing 1 to 12 carbon atoms, an aryl group containing 6 to 14 carbon atoms or an aralky group containing 7 to 15 carbon atoms which in turn these groups may be substituted by a hydroxyl, amino, alkylamino, alkoxy or alkyl containing 1 to 6 carbon atoms.

11. Material according to claim 1 wherein the silver halide emulsion is a silver bromide or silver iodobromide emulsion.

12. Material according to claim 1 wherein the silver halide emulsion is sensitized to red and/or infrared light.

13. Material according to claim 1, wherein the phosphonium compound has the formula (P)

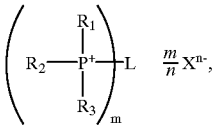

(P)

wherein $R_1$, $R_2$ and $R_3$ are identical or different and each represent an alkyl, cycloalkyl, aryl, alkenyl or cycloalkenyl group or a heterocyclic group, wherein these groups may each also have a substituent, L represents an m-valent organic group bond to the phosphorus atom via a carbon atom, n represents 1, 2 or 3, X represents an n-valent anion which may also be bound to L.

14. A process for producing black and white negatives with ultrahard-gradation contrast which comprises imagewise exposing the material according to claim 1 and developing said imagewise exposed material to form an image.

* * * * *